United States Patent [19]

Blair et al.

[11] 4,343,606

[45] Aug. 10, 1982

[54] MULTI-STAGE PROCESS FOR COMBUSTING FUELS CONTAINING FIXED-NITROGEN CHEMICAL SPECIES

[75] Inventors: David W. Blair, Princeton; William Bartok, Westfield, both of N.J.; John P. Longwell, Cambridge; Adel F. Sarofim, Belmont, both of Mass.

[73] Assignee: Exxon Research & Engineering Co., Florham Park, N.J.

[21] Appl. No.: 120,651

[22] Filed: Feb. 11, 1980

[51] Int. Cl.[3] ..... F23M 1/00

[52] U.S. Cl. ..... 431/10; 110/341; 431/11

[58] Field of Search ..... 431/10, 11, 2, 351, 431/352; 60/39.02, 39.06; 110/341

[56] References Cited

U.S. PATENT DOCUMENTS

| | | | |
|---|---|---|---|
| 3,048,131 | 8/1962 | Hardgrove | 431/10 X |
| 4,021,186 | 5/1977 | Tenner | 431/10 |
| 4,054,407 | 10/1977 | Carubba et al. | 431/10 |
| 4,060,376 | 11/1977 | Peredi | 431/10 X |

*Primary Examiner*—Edward G. Favors

*Attorney, Agent, or Firm*—Richard E. Nanfeldt

[57] ABSTRACT

Fuels containing fixed-nitrogen chemical species are combusted in a multi-stage process. The process which converts substantially all of the fixed-nitrogen into molecular nitrogen (and thus avoids the formation of significant amounts of nitrogen oxides from the fixed-nitrogen) consists of four steps: (a) mixing said fuel with at least one first oxidizing agent in amounts such that the equivalence ratio of said fuel to said oxidizing agent is at least about 1.4; (b) partially combusting the mixture resulting from step (a) in at least one first stage at a first temperature of about 1850° to about 2150° K., with a residence time of at least 0.03 second; (c) mixing the combustion products resulting from step (b) with at least one second oxidizing agent in an amount such that the equivalence ratio of combustion products to the total amount of oxidizing agents in the mixture will be about 1.0 or less, such mixing taking place under conditions such that the temperature of the mixture will not exceed about 1800° K.; and (d) completely combusting the mixture resulting from step (c) in at least one second stage at a second temperature of less than about 1800° K.

17 Claims, No Drawings

MULTI-STAGE PROCESS FOR COMBUSTING FUELS CONTAINING FIXED-NITROGEN CHEMICAL SPECIES

SUMMARY OF THE INVENTION

The present invention relates to a multi-stage process for combusting a fuel containing fixed-nitrogen chemical species which comprises the steps of: (a) mixing said fuel with at least one first oxidizing agent in amounts such that the equivalence ratio of said fuel to said oxidizing agent is at least about 1.4; (b) partially combusting the mixture resulting from step (a) in at least one first stage at a first temperature of about 1850° to about 2150° K., with a residence time of at least 0.03 second; and more preferably 0.15–0.25 second; (c) mixing the combustion products resulting from step (b) with at least one second oxidizing agent in an amount such that the equivalence ratio of combustion products to the total amount of oxidizing agents in the mixture will be about 1.0 or less, such mixing taking place under conditions such that the temperature of the mixture will not exceed about 1800° K.; and (d) completely combusting the mixture resulting from step (c) in at least one second stage at a second temperature of less than about 1800° K.

It is well known that common fuels such as coal, coal liquids, diesel oils, bunker oils, crude oils, shale oils, natural gas, etc. contain varying amounts of fixed-nitrogen chemical species. It is also well known that combustion of such fuels will produce varying amounts of nitrogen oxides (e.g. 150–1500 ppm), depending on the type and quantity of fixed-nitrogen chemical species as well as the furnace and burner arrangements.

It is axiomatic that it would be desirable to minimize the formation of nitrogen oxides without any significant impairment of the combustion efficiency. This desirable result has been achieved by means of the instant multi-stage combustion process, since this process results in the conversion of substantially all of the fixed-nitrogen chemical species contained in the fuel into innocuous molecular nitrogen (rather than nitrogen oxides) without any significant concommitant impairment of combustion efficiency.

THE PRIOR ART

U.S. Pat. No. 3,048,131 teaches a two-stage method for combusting nitrogen-containing fuels in order to minimize the production of $NO_x$ species in the combustion products. However the results achieved by the instant process surpass those of this patent. Moreover, this patent contains no teaching whatsoever of the four critical steps (outlined above) of this process.

The M.S. thesis by Howard W. Chou entitled "Fate of Ammonia In Fuel Rich Flames" (deposited in the library of the Massachusetts Institute of Technology on Oct. 25, 1976) indicates the desirability of combusting fuels under fuelrich conditions (i.e. high equivalence ratios) and at elevated temperatures. However, the Chou thesis does not indicate the necessary residence times for the first stage combustion. Moreover, Chou did his work at flame temperatures corresponding to adiabatic or less and at equivalence ratios greater than unity. In contrast thereto, this process involves three interrelated parameters in the first stage: high temperatures (e.g. 1850°–2150° K.), high equivalence ratios (e.g. at least 1.4) and minimum residence times (e.g. at least 0.03 second).

Other relevant prior art processes are summarized in the paper entitled "Mechanisms and Kinetics/$NO_x$ Formation" by A. F. Sarofim et al. which was presented at the 69th annual meeting of the American Institute of Chemical Engineers on Nov. 30, 1976 and is incorporated herein by reference.

DETAILS OF THE PRESENT INVENTION

This combustion process is multi-stage in nature, i.e. it involves one or more first stages and one or more second stages. The combustion process may be practiced with any desired type of combustion chamber/burner, so long as the chamber/burner is capable of being utilized in accordance with the four critical steps outlined above. Further, the same combustion chamber(s) employed in the second stage(s) may be the same as or different from that employed in the first stage(s).

The first step of this process involves mixing a fuel with a first oxidizing agent. The fuel may be a solid, a liquid, a gas or a mixture thereof such as the common fuels previously mentioned. The quantity and type of fixed-nitrogen chemical species contained in the fuel is relatively unimportant; however, most common fuels contain less than about 5 wt. % of such chemical species.

Typically, the first oxidizing agent is air; however oxygen, oxygen mixed with an inert gas such as helium, etc. may also be employed instead of air. If desired, the air may be enriched with oxygen, e.g. 6–15 wt. % of oxygen may be added to the air, based on the weight of the additional oxygen plus air. Further, it may also be useful to preheat the air to a temperature in the range of 450° to 1100° K. and preferably 600°–900° K., prior to its admixture with the fuel. If desired, the fuel may also be preheated to similar temperatures prior to admixture with the air.

The amount of oxidizing agent mixed with the fuel is such that an equivalence ratio of at least about 1.4 is obtained; preferably, the equivalence ratio is in the range of 1.4 to 2.2, most preferably 1.6 to 2.0. The equivalence ratio (usually referred to as $\phi$) is defined as:

$$\text{Equivalence ratio } (\phi) = \frac{\dfrac{\text{actual fuel}}{\text{actual oxidizing agent}}}{\dfrac{\text{stoichiometric fuel}}{\text{stoichiometric oxidizing agent}}}$$

For complete combustion (e.g., oxidation of carbon monoxide to carbon dioxide), $\phi$ should be equal to or less than 1.0. Where $\phi$ has a value equal to or greater than 1.4, carbon will be oxidized to carbon monoxide plus carbon dioxide. It should also be noted that while a condition of $\phi \leqq 1.0$ is desirable from a complete combustion point of view, such condition favors conversion of fixed-nitrogen chemical species into nitrogen oxides. Thus by combusting in at least two stages in which the first stage(s) $\phi \leqq 1.4$ and the second stage(s) $\phi \leqq 1.0$, both minimization of the formation of nitrogen oxides and maximization of complete combustion are obtained.

The mixture of fuel and first oxidizing agent may be formed externally to, or within, a suitable combustion chamber. In the second step of this process, the mixture is partially combusted (i.e. carbon is oxidized to carbon monoxide plus carbon dioxide) in at least one first stage. The combustion temperature of this first stage is maintained in the range of about 1850° to about 2150° K., preferably 1900° to 2050° K. Further, the residence time of the fuel and oxidizing agent during the combustion reaction is maintained at a level of at least about 0.03 second, preferably 0.05 second, e.g. 0.2 second.

The combustion products resulting from the second step (i.e. the first stage combustion) are then mixed with a second oxidizing agent (which may be the same as or different from the first oxidizing agent employed in the first step). Typically, the second oxidizing agent is also air, but it may be any of the other choices enumerated above for the first oxidizing agent. The amount of oxidizing agent employed in the third step is such that the equivalence ratio of combustion products to the total amount of oxidizing agents (i.e. any remaining first oxidizing agent plus the added second oxidizing agent) is equal to or less than 1.0, e.g. 0.80–0.99.

Since an equivalence ratio of 1.0 or less favors the formation of $NO_x$ species at elevated temperatures, it is necessary that the mixing in the third step take place under conditions such that the temperature of the combustion products-second oxidizing agent mixture is maintained at a level not in excess of about 1800° K., e.g. 1200°–1750° K. This may be readily accomplished by several techniques, e.g. cooling of the combustion chamber, transfer of the combustion products to a different "cold" combustion chamber, cooling of the combustion products (e.g. by suitable heat exchangers) to a temperature of less than 1300° K. Furthermore, cooling may not necessarily be required, e.g. the temperature of the combustion products in relation to the temperature, requisite amount, and rate of mixing, of the second oxidizing agent may be such that the temperature will at all times be below about 1800° K.

The mixing of combustion products and second oxidizing agent may, as in the case of the first step, take place external to, or within the same or different combustion chamber as was employed in the first stage combustion (i.e. the second step). Further, where the second oxidizing agent is chosen to be air, the air may be enriched with the same levels of additional oxygen as mentioned above with respect to the first oxidizing agent (provided that an equivalence ratio of $\leqq 1.0$ is maintained for the mixture).

The second oxidizing agent (e.g. air) may be preheated and/or enriched with oxygen as was the case with respect to the first oxidizing agent. Further, the second oxidizing agent may be diluted with combustion products and/or inert gases prior to and/or during admixture with the combustion products resulting from the first stage. These alternatives, however, are subject to the proviso that the equivalence ratios and maximum temperatures outlined above must nevertheless be maintained.

In the fourth step, the mixture of combustion products and second oxidizing agent is completely combusted in at least one second stage (in the same or different combustion chamber as that employed in the first stage combustion). The term "completely" combusted is used herein to denote that partially oxidized combustion products (e.g. carbon monoxide) resulting from the first stage combustion are further oxidized to their highest oxidation state (e.g. carbon dioxide). The fourth step is carried out at a temperature of less than about 1800° K., preferably 1200° to 1750° K. The residence times for the second stage depend on the fuel but are not critical, i.e. they need be only long enough to oxidize substantially all of the carbon monoxide and other remaining combustibles (from the first stage combustion) into carbon dioxide. Typically, residence times of 0.1 to 1.0 second will be sufficient for the second stage combustion. For boilers or process furnaces, residence times of 0.5 to 1.0 sec. are anticipated. For gas turbines, the second stage residence time will be shorter, typically less than 0.1 sec.

EXAMPLE 1

In this example and in Example 2 below, attention was focused on the first stage of the combustion process. Once the conversion of fixed-nitrogen chemical species to molecular nitrogen has been maximized by the first stage process conditions of this invention, completing the combustion in the second stage (at equivalence ratios of 1.0 or less) and at lower temperatures (about 1750° K. or less) presents no problem vis-a-vis minimization of $NO_x$ formation.

The apparatus employed in Examples 1 and 2 consisted of an electrically-heated vertical muffle-tube furnace; the furnace was constructed of zirconia and was 5.40 cm. I.D.×60.64 cm. long (the heated zone was 35.56 cm. long). The reactants (i.e. premixed fuel and air) were fed to the bottom of the muffle-tube through a porous plug flat flame burner of b 2.54 cm. diameter (the face of the burner was located 4.92 cm. below the heated zone). Gas samples for analysis of $O_2$, NO and $NO_x$ were withdrawn through a water-cooled stainless steel probe that was axially located 41.91 cm. above the burner face. Gas samples for analysis of HCN and $NH_3$ were withdrawn from the cool burner exhaust duct, approximately 99 cm. above the burner face.

In Example 1, methane was doped with approximately 5,000 ppm NO and mixed with air so as to result in a mixture having an equivalence ratio of 1.7. The results in terms of the output of the sum of NO, $NH_3$ and HCN as a mole percent of the input NO versus various adiabatic flame temperatures are shown in Table I below.

TABLE I

| Output, Mole % | Flame Temp., °K. |
|---|---|
| 30.7 | 1762 |
| 17.3 | 1824 |
| 10.5 | 1884 |
| 8.04 | 1940 |
| 6.57 | 1994 |
| 6.32 | 2045 |

EXAMPLE 2

Example 1 was repeated under the same conditions, except that the methane was doped with 4376 ppm $NH_3$ (instead of the 5000 ppm NO). Table II set forth below indicates the wall temperature of the combustion chamber, the adiabatic flame temperature, the equivalence ratio and the output, mole fraction of input $NH_3$ appearing as the sum of $NH_3$, NO plus HCN in the combustion products.

TABLE II

| Wall Temp., °K. | Adiabatic Flame Temp., °K. | Equivalence Ratio | Output, Mole Fraction |
|---|---|---|---|
| 1658 | 2232 | 1.01 | 0.703 |
| 1658 | 2191 | 1.13 | 0.584 |
| 1658 | 2121 | 1.22 | 0.522 |
| 1658 | 2052 | 1.31 | 0.411 |
| 1658 | 1981 | 1.40 | 0.266 |
| 1658 | 1915 | 1.49 | 0.253 |

TABLE II-continued

| Wall Temp., °K. | Adiabatic Flame Temp., °K. | Equivalence Ratio | Output, Mole Fraction |
|---|---|---|---|
| 1658 | 1849 | 1.58 | 0.233 |
| 1658 | 1705 | 1.78 | 0.409 |
| 1658 | 1570 | 1.99 | 0.433 |
| 1658 | 1450 | 2.19 | 0.408 |

EXAMPLES 3-7

The experimental apparatus described in Example 1 was used with some modifications to obtain the results presented in the examples that follow. All of the experimental data were obtained in a $NH_3$ doped, premixed methane-nitrogenoxygen system that was reacted in an isothermal combustor where the wall temperature was matched to the theoretical adiabatic combustion temperature of the flame corresponding to each set of test conditions. The 2.54 cm diameter porous flat flame burner of Example 1 was replaced by a 5.0 cm diameter porous plate flat flame burner in the bottom end of the vertical furnace reactor. Most of the data were obtained using a vertical tubular furnace constructed of zirconia with dimensions of 5.40 cm I.D. by 60.64 cm long (the heated zone was 35.56 cm long). In a few test runs, a furnace constructed of alumina with the same dimensions was used without any noticeable effect on the reaction products. Combustion reaction product compositions were determined by withdrawing samples isokinetically through a quartz lined water cooled stainless steel probe that was inserted into the furnace from the top and could be moved by external actuation to predetermined axial positions along the center of the furnace. The tip of the sampling probe was positioned to correspond to the reaction time requirements specified for the isothermal plug flow reaction zone in each series of test.

EXAMPLE 3

The experimental results were obtained at a constant reaction time of 300 msec isothermally at a temperature of 1850° K. to determine the effect of the equivalence ratio on the total fixed nitrogen content of the combustion products. FIG. 1 presents the results in graphical form as a plot of the sum of total fixed nitrogen expressed as the percent of the input $NH_3$ (600 ppm) added to the premixed methane-nitrogen-oxygen mixture. In these experiments, the amount of oxygen used was adjusted to provide the selected conditions of equivalence ratio and adiabatic flame temperature for each test run.

The results of FIG. 1 clearly show that a minimum occurs in the value of the total fixed nitrogen (sum of the concentrations of NO, $NH_3$ and HCN) at a value of the equivalence ratio of about 1.75. This minimum value is about 20% of the input ammonia.

EXAMPLE 4

The results of Example 4 were obtained again using premixed reactants of methane, oxygen, nitrogen and ammonia. As in Example 1, the input ammonia concentration was 600 ppm. For this set of test runs. the reaction temperature in the furnace was controlled at 1950° K.

Consistent with the teaching of the present invention, the minimum value of the fixed nitrogen concentration (again expressed as the percent of the input $NH_3$) decreased to a lower value at 1950° K. compared to the results obtained at 1850° K. As shown by the results in FIG. 2, the minimum value of the fixed nitrogen is about 10% of the input $NH_3$ at a value of the equivalence ratio of about 1.8. Comparison of FIGS. 1 and 2 shows that the entire curve of fixed nitrogen plotted as a function of the equivalence ratio is shifted to lower values by raising the temperature.

EXAMPLE 5

The effect of reaction temperature was studied further at 2050° K. using methane, oxygen, nitrogen and ammonia mixtures with an input concentration of 600 ppm $NH_3$. As shown by the result in FIG. 3 which presents fixed nitrogen plotted vs. equivalence ratio at 2050° K. in 300 msec, a further reduction in fixed nitrogen can be achieved by this increase in temperature at about $\phi=1.85$ to a value of about 8% of the input $NH_3$.

The trend for the value of $\phi$ corresponding to minimum fixed nitrogen to shift to higher values with increasing temperature is consistent with thermodynamic equilibrium calculations for such reactant mixtures.

EXAMPLE 6

In this set of experiments, mixtures of methane, oxygen, nitrogen and 600 ppm $NH_3$ were reacted at a temperature of 1850° K. and a value of $\phi=1.7$, as a function of reaction time up to 300 msec. The $\phi$ value was selected to correspond to the minimum in fixed nitrogen previously determined for 300 msec and 1850° K. in Example 3.

FIG. 4 shows the results of these time resolved measurements. Following an initial transient buildup in fixed nitrogen, presumably due to some further fixation of atmospheric nitrogen, the fixed nitrogen concentration of the fuel rich combustion products decreases rapidly with reaction time for about the first 100 msec. It is seen that after about 50 msec, about 30% of the $NH_3$ input remains as fixed nitrogen. After 100 msec, the fixed nitrogen decreases to about 27% and after about 200 msec, 22% of the $NH_3$ input.

EXAMPLE 7

A similar set of time resolved measurements as in Example 6 were made, but at a higher temperature of 1950° K. Again reactant mixtures of premixed methane, oxygen, nitrogen and 600 ppm $NH_3$ were used. At a reaction temperature of 1950° K., the $\phi$ value selected was 1.8 to correspond to the minimum in fixed nitrogen observed in the results presented in Example 4.

The results are presented in FIG. 5. After an initial transient increase in the concentration of fixed nitrogen species, their concentration decreases even more rapidly with reaction time than at the lower temperature of Example 6. Because of the initial larger increase in fixed nitrogen, the actual values of fixed nitrogen concentration are seen to be higher at 1950° K. than at 1850° K. up to a reaction time of about 60 msec (at that reaction time the fixed nitrogen is about 30% of the $NH_3$ input). At 100 msec the fixed nitrogen is about 22% of the $NH_3$ input, at 200 msec it is about 15%, and at 300 msec it is about 10% of the $NH_3$ input.

What is claimed is:

1. A multi-stage process for combusting a fuel containing fixed-nitrogen chemical species which comprises the steps of:

(a) mixing said fuel which is preheated with at least one first oxidizing agent which is preheated in amounts such that the equivalence ratio of said fuel to said oxidizing agent is at least about 1.6;

(b) partially combusting the mixture resulting from step (a) in at least one first stage at a first temperature of about 1850° to about 2150° K., with a residence time of at least 0.03 second;

(c) mixing the combustion products resulting from step (b) with at least one second oxidizing agent in an amount such that the equivalence ratio of combustion products to the total amount of oxidizing agents in the mixture will be about 1.0 or less, such mixing taking place under nonadiabatic means such that the temperature of the mixture will not exceed about 1800° K.; and (d) completely combusting the mixture resulting from step (c) in at least one second stage at a second temperature of less than about 1800° K.

2. The process according to claim 1 wherein the first temperature is in the range of 1900° to 2050° K.

3. The process according to claim 1 wherein the residence time is at least 0.05 second.

4. The process according to claim 1 wherein the equivalence ratio of the mixture resulting from step (a) is in the range of about 1.4 to about 2.2.

5. The process according to claim 4 wherein the equivalence ratio is in the range of 1.6 to 2.0.

6. The process according to claim 1 wherein the first oxidizing agent is air.

7. The process according to claim 6 wherein the air is preheated to less than about 1100° K. prior to its admixture with said fuel.

8. The process according to claim 1 wherein the fuel is a solid, liquid, gas, or a mixture thereof.

9. The process according to claim 1 wherein the second oxidizing agent is air.

10. The process according to claim 1 wherein the second temperature is in the range of 1200° to 1800° K.

11. The process according to claim 1 wherein the residence time is about 0.15 to about 0.25 seconds.

12. The process according to claim 6 wherein the air is preheated to less than about 900° K. prior to its admixture with said fuel.

13. The process according to claim 1 wherein said fuel is a liquid or gas.

14. The process according to claim 1 wherein the second temperature is in the range of 1300° to 1750° K.

15. A multi-stage process for combusting a fuel containing fixed-nitrogen chemical species in a combustion chamber which comprises the steps of: p1 (a) mixing the fuel with air which has been preheated to a temperature in the range of 450° to 1100° K., the air being present in an amount such that the equivalence ratio of fuel to air is in the range of 1.6 to 2.0;

(b) partially combusting the mixture resulting from step (a) in the combustion chamber at a temperature in the range of 1900° to 2050° K. with a residence time of at least 0.05 second;

(c) cooling the combustion products resulting from step (b) to a temperature of less than 1600° K.;

(d) mixing the cooled combustion products resulting from step (c) with air in an amount such that the equivalence ratio of combustion products to the total amount of air present in the mixture will be less than 1.0; and (e) completely combusting the mixture resulting from step (d) in the same or different combustion chamber as that employed in step (b), such complete combustion taking place at a temperature in the range of 1200° to 1800° K.

16. The process of claim 15 wherein said fuel is a liquid or gas.

17. A process according to claim 6 wherein said air is enriched with 6–15 weight percent oxygen.

* * * * *